United States Patent [19]

Margraf

[11] 4,284,131

[45] Aug. 18, 1981

[54] COOLER FOR HOT SMOKE-LADEN GASES

[76] Inventor: Adolf Margraf, Am Schleplingsbach 46, Stadthagen Wendthagen, Fed. Rep. of Germany

[21] Appl. No.: 964,826

[22] Filed: Nov. 30, 1978

[51] Int. Cl.[3] ..... F28F 9/12

[52] U.S. Cl. ..... 165/76; 165/175; 165/178; 285/137 R; 285/189

[58] Field of Search ..... 165/69, 76, 178, 173, 165/175; 285/137 R, 189, 196, 205

[56] References Cited

FOREIGN PATENT DOCUMENTS 2730674 1/1979 Fed. Rep. of Germany ..... 165/175

*Primary Examiner*—Sheldon J. Richter

*Attorney, Agent, or Firm*—Kinzer, Plyer, Dorn & McEachran

[57] ABSTRACT

The invention relates to a cooler for hot smoke-laden gases which are to be cleaned by a pocket or tube filter situated in a downstream location. The cooler has a housing provided with cooling elements through which cold external air is conducted perpendicular to the direction of flow of the smoke-laden gas. The cooling elements are loose tubes of generally oval shape which project through perforations in two opposing walls of the cooler housing. Associated with each end of each cooling tube outside the cooler housing is an annular flange, which, by means of at least one spring presses an annular gasket situated between itself and the outer wall into the annular gap between the cooling tube and the perforation in the wall of the housing.

2 Claims, 4 Drawing Figures

COOLER FOR HOT SMOKE-LADEN GASES

BACKGROUND OF THE INVENTION

The present invention relates to a cooler for hot smoke-laden gases which are to be cleaned by a pocket or tube filter situated in a downstream location, the cooler having a housing of rectangular horizontal cross-section through which the smoke-laden gas flows from top to bottom or from bottom to top and which is provided with cooling elements through which cold external air is conducted perpendicular to the direction of flow of the smoke-laden gas around the cooling elements.

To allow hot smoke-laden gases, e.g. from smelting furnaces, to be cleaned by means of pocket or tube filters, the temperature of the gases must be reduced to a level which can be tolerated by the particular filter material involved. There have generally been used for this purpose, so-called pocket coolers in which the open ends of the pockets are fitted over perforations in two opposing walls of the housing, the pockets, which are of the same height as the cooler housing, being fastened to the walls in a sealed fashion, e.g. by screws. The vertical surfaces of the pocket then provide a large area of heat-exchange surface in the enclosed space and they are freed from the dust which clings to them by swinging chains or cables.

The pockets of known coolers are expensive to manufacture and the thermal stresses which arise may cause them to bulge or distend and thus hamper the cleaning by the chains. It is particularly difficult to seal such large cooling pockets satisfactorily and it can therefore always be expected that a fairly large amount of extraneous air will infiltrate into the smoke-laden gas. Apart from the high resistance offered to the flow of the cooling air through the pockets, it is an expensive and laborious business to exchange the large pockets when defective.

An object of the invention is to enable cooling elements in coolers for hot smoke-laden gases having a pocket or tube filter connected in a downstream location to be sealed satisfactorily and to be fitted and removed in a particularly simple fashion.

A further object is to reduce substantially the cost of manufacturing the cooling elements while lessening the risk of their bulging out and whilst ensuring an almost equally favourable utilisation of the available space as compared with cooling pockets.

SUMMARY OF THE INVENTION

The objects are achieved in accordance with the invention by virtue of the fact that in a cooler for hot smoke-laden gases of the kind hereinbefore described, the cooling elements are loose tubes of sheet steel, advantageously of generally oval or flattened oval shape, which project through perforations in two opposing walls of the cooler housing and which are arranged one above the other and in parallel rows, and by virtue of the fact that associated with each end of each cooling tube outside the cooler housing is an annular flange which, by means of at least one traction or compression spring, presses an annular gasket situated between itself and the outer wall into the annular gap between the cooling tube and the perforation in the wall of the housing.

By using oval or flattened oval tubes of sheet steel with their major axis in a vertical position it is possible for the production of the cooling elements to be considerably simpler and cheaper than that of cooling pockets, the cooling elements being subject to no distension or only slight distension as a result of thermal stresses, because of their dimensions, and thus not hampering cleaning of a known kind by swinging chains or cables. The arrangement of the cooling tubes above one another and in parallel rows ensures that the utilisation of the available space is virtually the same as when cooling pockets are used.

Above all, the cooling tubes are made easier to fit and to seal properly by virtue of the facts that they can be inserted loosely through the perforations in the wall of the cooler housing and that the annular flanges, by tensile or compressive stress, press the annular gaskets, e.g. of asbestos, into the annular gaps between the cooling tubes and the perforations in the wall to produce a satisfactory seal. This pressure is maintained even if the sealing gaskets shrink or become brittle after a time so that even then a seal is always guaranteed.

The pressure which is to be exerted on the gasket by tensile or compressive stress can be achieved by various constructional measures which will be explained hereinafter in detail.

BRIEF DESCRIPTION OF THE DRAWINGS

Other features and advantages of the invention will become apparent from the following description given with reference to the accompanying drawings.

DESCRIPTION OF PREFERRED EMBODIMENTS

Figure 4:
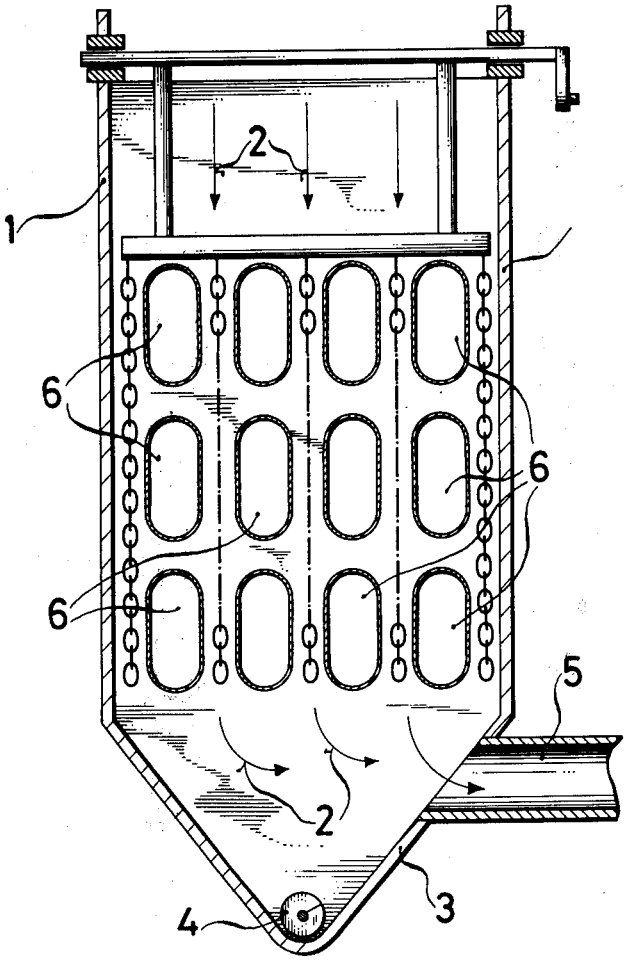
FIG. 4 is a schematic vertical section, perpendicular to the cooling tubes, through a cooler according to the invention.

A cooler for hot smoke-laden gases having a pocket or tube filter situated in a downstream location comprises a housing 1 (FIG. 4) of rectangular or approximately rectangular horizontal cross-section, to which the hot smoke-laden gas is fed from the top downwards in the directions of arrows 2. The housing 1 is provided with a dust collecting trough 3 at the bottom and an extractor screw 4 together with an outlet 5 leading to the filter. It is however also possible for the open bottom side of the housing 1 to be connected directly to the housing of a pocket or tube filter or for the housing to built into the filter housing.

Two opposing walls 1*a*, 1*b* of the housing are provided with parallel rows of perforations situated one above the other which are advantageously of oval or flattened oval shape with the major axis in a vertical position. In the FIG. 1 embodiment, each of these perforations has loosely inserted in it an oval or flattened oval tube 6 of sheet steel, with the ends of the tube advantageously projecting slightly on the outside. Cooling air flows through the cooling tubes 6 perpendicularly to the flow 2 of smoke-laden gas to allow the temperature of the smoke-laden gas to be reduced by heat exchange. Extending centrally through each tube 6 is a rod 7 to which is secured, advantageously in a detachable manner, one end of at least one pair of traction spring 8 and 9. The other end of the traction springs 8, 9 is connectable under tension to an annular flange 10 or 11, between which and the the wall 1*a* or 1*b* is inserted an annular gasket 12, e.g. of asbestos. This gasket is compressed by the annular flange 10 or 11, due to the stress exerted by springs 8, 9, and is thus pressed into the annular gap between the cooling tube 6 and the perforation in the wall. The procedure at the time of fitting is that, after the cooling tube 6 together with the rod 7 and the springs 8, 9 has been inserted; the outer ends of the springs 8, 9 are engaged under tension with a hooked part of the annular flanges 10, 11.

Figure 1:
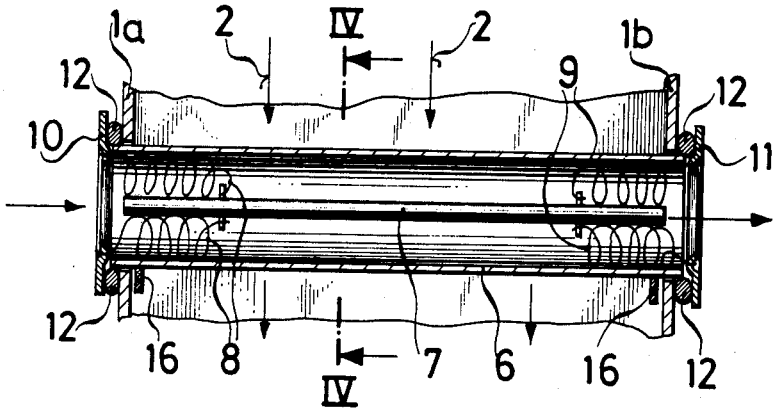
FIGS. 1 to 3 are three vertical, axial sections through cooling elements which are mounted in a cooler housing in different respective fashions.

With the embodiment shown in FIG. 1 it is possible for the rod 7 to be omitted and the inner ends of the springs 8, 9 then to be connected to the inside of the cooling tube 6.

Figure 2:
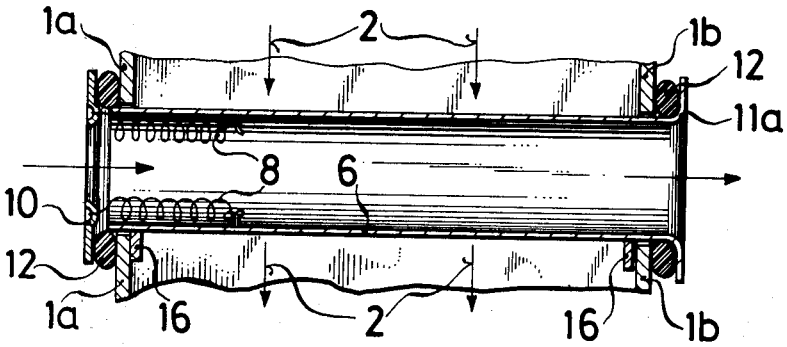

In the embodiment shown in FIG. 2, the cooling tubes 6 are provided at one end with a fixed annular flange 11*a* between which and the wall 1*b* of the housing is inserted the annular gasket 12. At the other end of the tube, one end of at least one traction spring 8 is fastened to the inside of the tube whilst the other end of the spring is once again detachably connected under tension to a loose annular flange 10. As a result of the tractive force from the spring, the annular gaskets 12 at both ends are compressed and seal the annular gap between the cooling tube 6 and the perforation in the wall of the housing.

Figure 3:
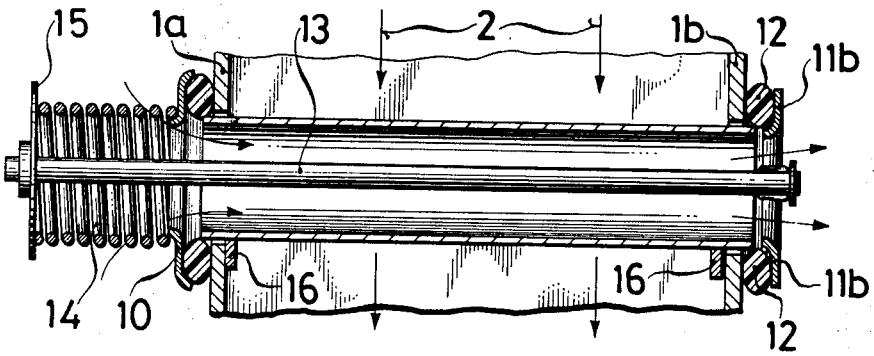

In the embodiment of FIG. 3, each cooling tube 6 is once again loosely inserted through the perforations in the two walls 1*a* and 1*b* of the housing. In this case an annular flange 11*b* is provided on the outside of wall 1*b* and is connected by struts to a rod 13 extending through the cooling tube 6. On the outside of wall 1*a* of the housing, the rod 13 is surrounded by a compression spring 14 which bears at one end against a washer 15 and at the other end, under compression, against an annular flange 10. In this case, as before, annular gaskets 12 are situated between the annular flanges 11*b* and 10 and the walls 1*a*, 1*b* and, as a result of the force exerted by the compression spring 14, they provide a seal which always remains the same.

With coolers of the present kind in order to cool smoke-laden gas thoroughly a very large number of cooling tubes are required in the cooler housing. In one embodiment, sixty cooling tubes 6 would have to be mounted in one square meter of the walls 1*a*, 1*b*, the springs 8, 9, 14 of each cooling tube being loaded to 50 to 100 kg. Very large tractive or compressive stresses are therefore exerted on the walls 1*a*, 1*b*. To counteract these forces on the walls, the cooling tubes 6 are provided, on the inside of the walls 1*a*, 1*b*, with abutments 16 which bear against the insides of walls 1*a*, 1*b*, thus preventing the walls of the housing from bowing inwards.

It will be apparent that the invention is not limited to the embodiments herein described, but that various modifications will be apparent to those skilled in the art without departing from the scope of the appended claims.

I claim:

1. A cooler for hot smoke-laden gases which are to be cleaned by a pocket or tube filter situated in a downstream location, the cooler having a housing of generally rectangular horizontal cross section through which the smoke-laden gas flows from top to bottom or from bottom to top, and which is provided with cooling elements within the housing through which cold external air is conducted perpendicularly to the direction of flow of the smoke-laden gas around the cooling elements, and wherein:

the cooling elements are loose tubes of generally oval or flattened oval shape, which project through openings in two opposing walls of the cooler housing, said tubes being arranged above one another and in parallel rows, an annular flange associated with each end of each cooling tube outside the cooler housing, which, by means of at least one traction or compression spring, presses an annular gasket situated between itself and the outer wall of the housing into the annular gap between the cooling tube and the associated opening in the wall of the housing, and wherein the cooling tubes have in the vicinity of their ends at least one supporting abutment which bears against the inside of the walls of the housing.

2. A cooler for hot smoke-laden gases which are to be cleaned by a pocket or tube filter situated in a downstream location, the cooler having a housing of generally rectangular horizontal cross section through which the smoke-laden gas flows from top to bottom or from bottom to top, and which is provided with cooling elements within the housing through which cold external air is conducted perpendicularly to the direction of flow of the smoke-laden gas around the cooling elements, and wherein:

the cooling elements are loose tubes of generally oval or flattened oval shape, which project through openings in two opposing walls of the cooler housing, said tubes being arranged above one another and in parallel rows, an annular flange associated with each end of each cooling tube outside the cooler housing, which, by means of at least one traction or compression spring, presses an annular gasket situated between itself and the outer wall of the housing into the annular gap between the cooling tube and the associated opening in the wall of the housing, a loose annular flange associated with each of the ends of each cooling tube, and each such loose annular flange being connected to one end of a pretensioned traction spring having its other end connected to the inside of the cooling tube or to a rod which passes loosely through the cooling tube.

* * * * *